United States Patent [19]

Lange

[11] Patent Number: 4,616,571

[45] Date of Patent: Oct. 14, 1986

[54] PANEL SECTION INTERCONNECTING MEMBER AND A SHELF STRUCTURE USING A PLURALITY OF THE PANEL SECTION INTERCONNECTING MEMBERS

[75] Inventor: Gerd Lange, Kapsweyer, Fed. Rep. of Germany

[73] Assignee: Willy Glaser, Baden, Switzerland

[21] Appl. No.: 613,084

[22] Filed: May 22, 1984

[51] Int. Cl.[4] ..... A47B 47/04

[52] U.S. Cl. ..... 108/111; 211/189; 446/112

[58] Field of Search ..... 108/111; 312/140; 403/171, 176; 446/111, 112, 115; 211/189

[56] References Cited

U.S. PATENT DOCUMENTS

| | | | |
|---|---|---|---|
| 3,685,465 | 8/1972 | Haumer | 108/111 |
| 3,913,289 | 10/1975 | Recker | 108/111 X |
| 3,955,510 | 5/1976 | Kinik | 108/111 |
| 3,973,855 | 8/1976 | Florence | 403/171 |
| 4,124,958 | 11/1978 | Chiche | 312/140 X |
| 4,301,636 | 11/1981 | Luria | 312/140 X |

*Primary Examiner*—Peter A. Aschenbrenner
*Attorney, Agent, or Firm*—Yount & Tarolli

[57] ABSTRACT

The invention discloses a panel section interconnecting member adapted to be used in the construction of shelf structures or shelf-like furniture. It comprises a generally rectangular base plate member of essentially flat configuration, one surface thereof comprising four generally tetrahedrally shaped supporting members protruding therefrom. First side walls of the supporting members are arranged essentially parallel and with a certain distance to second side walls of an adjacent supporting member, defining therebetween receiving channels adapted to receive horizontal and vertical panel members of a shelf structure to be erected. The so-formed channels thereby have an essentially cross-like configuration and the base plate comprises a central opening provided in the center of said cross for receiving a mounting screw or the like mounting member to mount the interconnecting member to a wall. The side walls of the channels are narrower in the region of their top side than at the bottom side to effect a clamping action on a panel member received therein.

14 Claims, 10 Drawing Figures

PANEL SECTION INTERCONNECTING MEMBER AND A SHELF STRUCTURE USING A PLURALITY OF THE PANEL SECTION INTERCONNECTING MEMBERS

BACKGROUND OF THE INVENTION

The present invention refers to a panel section interconnecting member useful in the art of construction of shelves or shelf-like furniture, either mounted to a wall or self standing. The panel section interconnecting members serve to interconnect a plurality of horizontally extending panel members and a plurality of vertically extending panel members, being part of a shelf.

PRIOR ART

Up to now shelf-like furniture like bookshelves or the like have been constructed by joining the vertically and horizontally extending panel members together in a suitable way, either by glueing or by screwing. It is thereby cumbersome to erect a shelf exactly according to the wishes of a user with regard to size and appearance, and usually quite a lot of tools and experience will be needed if the furniture piece has to be constructed by a user which is not well qualified in the art.

Hitherto a number of interconnecting members useful in erecting a bookshelf have been proposed, but which are complicated to use and are not in a position to offer a freedom of creative design of a furniture to be planned and realized by the user itself in sufficient manner.

OBJECTS OF THE INVENTION

It is therefore a principal object of the invention to provide a panel section interconnecting member which can be universally used to erect a shelf or shelf-like furniture, either to be connected to a wall or self-standing.

It is a further object of the invention to provide a panel section interconnecting member for the construction of either a single-sided or a double-sided shelf structure with the help of a plurality of vertically extending and horizontally extending panel members.

It is a still further object of the invention to provide a shelf structure of simple, but pleasant design which may be constructed according to the wishes of the user, which may easily be dismantled and erected again without any damage to any part of the structure.

It is a still further object of the invention to provide a shelf structure which may be assembled without the use of any tools, but by merely inserting the horizontal and vertical panel members into the panel section interconnecting members, which may be mounted to a wall or pairwise mounted together for the construction of a free-standing shelf structure.

SUMMARY OF THE INVENTION

The present invention provides a panel section interconnecting member adapted to be used in the construction of shelf structures or shelf-like furniture, which comprises a generally rectangular base plate member of essentially flat configuration having a first surface, a second surface opposite to said first surface and four side edges. First, second, third and fourth generally tetraedically shaped supporting members are rigidly mounted at said first surface of the base plate member and protrude therefrom, each of said supporting members including a first and a second triangular side wall arranged essentially perpendicular to said first surface of said base plate member, and a third oblique triangular surface constituting the top surface of the supporting members.

Each of said first and said second triangular sidewall of each of said supporting members together include a right angle.

The first side wall of the first supporting member is arranged essentially parallel and with a certain distance to the second side wall of the second supporting member, thereby defining therebetween a first receiving channel adapted to receive a panel member of a shelf structure to be erected. The first side wall of the second supporting member is arranged essentially parallel and with a certain distance to the second side wall of the third supporting member, thereby defining therebetween a second receiving channel adapted to receive a panel member of a shelf structure. The first side wall of the third supporting member is arranged essentially parallel and with a certain distance to the second side wall of the fourth supporting member, thereby defining therebetween a third receiving channel adapted to receive a panel member of a shelf structure, and the first side wall of the fourth supporting member is arranged essentially parallel and with a certain distance to the second side wall of the first supporting member, thereby defining therebetween a fourth receiving channel adapted to receive a panel member of a shelf structure.

Thereby the four channels have an essentially cross-like configuration and the base plate comprises a central opening provided in the center of said cross for receiving a mounting screw or the like mounting member.

Usually it would be most convenient if all said four supporting members are integrally formed with said base plate member, whereby said first, second, third and fourth supporting members are hollow and having an open back side.

Usually all four channels will have identical width, but sometimes it may be advantageous if said first and said third channel have a first width and said second and said fourth channel have a second width which is different from said first width.

In order to ensure a reliable fixing of the panel members in the panel section interconnecting members, it may be advantageous if the width of said first, second, third and fourth channel decreases from the ground adjacent to said base plate to the top thereof. According to a preferred embodiment, the width of said first, second, third and fourth channel at the top may be 1 to 5%, preferably 1 to 3% less than the width at the ground thereof.

In a further embodiment, there is provided a circumferential recess along the edges of the panel section interconnecting member adapted to receive the edges of background panel members.

Each of the hollow spaces of the protruding supportin members may be provided with a tube-like flange extending parallel to the central axis of the panel section interconnecting member and extending essentially up to said second surface of said base plate member. Clamping members associated with each of said tube-like flanges may be provided, adapted to be received thereon for clampingly retaining said background panel members.

The second surface of said base plate member may comprise a centrally arranged base fixing member consisting of two protruding sectors in juxtaposition, each sector extending over an angle of 90 degrees and being arranged around said central opening in said base plate member. Furthermore the second surface of said base plate member may comprise a first, second, third and fourth eccentrically arranged base fixing member, said first and said third base fixing member being diagonally arranged with regard to each other in the region of two opposed corners of said base plate member and said second and said forth base fixing member being diagonally arranged with regard to each other in the region of the other two opposed corners of said base plate member. The first and third base fixing members have cylindrical shape with a predetermined outer diameter, and the second and fourth base fixing members comprise a cylindrical recess, the diameter thereof corresponding to said predetermined outer diameter of said first and third base fixing members.

The invention further provides a shelf structure including a plurality of horizontally extending panel members, a plurality of vertically extending panel members and a plurality of panel section interconnecting members adapted to rigidly interconnect said vertically extending panel members and said horizontally extending panel members, each panel section interconnecting member comprising a generally rectangular base plate member of essentially flat configuration having a first surface, a second surface opposite to said first surface and four side edges, first, second, third and fourth generally tetraedically shaped supporting members rigidly mounted at said first surface of said base plate member and protruding therefrom, each of said first, second, third and fourth supporting members including a first triangular side wall arranged essentially perpendicular to said first surface of said base plate member, a second triangular side wall arranged essentially perpendicular to said first surface of said base plate member and a third oblique triangular surface constituting the top surface of said supporting members, each of said first and said second triangular sidewall of each of said first, second, third and fourth supporting members together including a right angle.

The first side wall of said first supporting member is arranged essentially parallel and with a certain distance to said second side wall of said second supporting member, thereby defining therebetween a first receiving channel adapted to receive a panel member of a shelf structure to be erected, said first side wall of said second supporting member being arranged essentially parallel and with a certain distance to said second side wall of said third supporting member, thereby defining therebetween a second receiving channel adapted to receive a panel member of a shelf structure to be erected, said first side wall of said third supporting member being arranged essentially parallel and with a certain distance to said second side wall of said fourth supporting member, thereby defining therebetween a third receiving channel adapted to receive a panel member of a shelf structure to be erected, and said first side wall of said fourth supporting member being arranged essentially parallel and with a certain distance to said second side wall of said first supporting member, thereby defining therebetween a fourth receiving channel adapted to receive a panel member of a shelf structure to be erected.

The first, second, third and fourth channel thereby have an essentially cross-like configuration and said base plate comprises a central opening provided in the center of said cross for receiving a mounting screw or the like mounting member.

The first channel of each of said panel section interconnecting members receives and supports a first vertically extending panel member, and said third channel of each of said panel section interconnecting members receives and supports a second vertically extending panel member, and said second and said fourth channels of each of said panel section interconnecting members together receive and support a horizontally extending panel member.

Finally the invention provides a shelf structure including a plurality of horizontally extending panel members, a plurality of vertically extending panel members and a plurality of pairs of panel section interconnecting members adapted to rigidly interconnect said vertically extending panel members and said horizontally extending panel members, said plurality of pairs of panel section interconnecting members consisting of a first panel section interconnecting member, the back side thereof being connected to a second panel section interconnecting member. Thereby the first and the second panel section interconnecting member may be of the same design as hereinbefore described and explained.

BRIEF DESCRIPTION OF THE DRAWINGS

In the following there will be described an embodiment of the panel section interconnecting member as well as several embodiments of panels constructed by means of and incorporating a plurality of the panel section interconnecting members according to the invention. Thereby reference is made to the accompanying drawings, in which.

DESCRIPTION OF PREFERRED EMBODIMENTS

Figure 1:
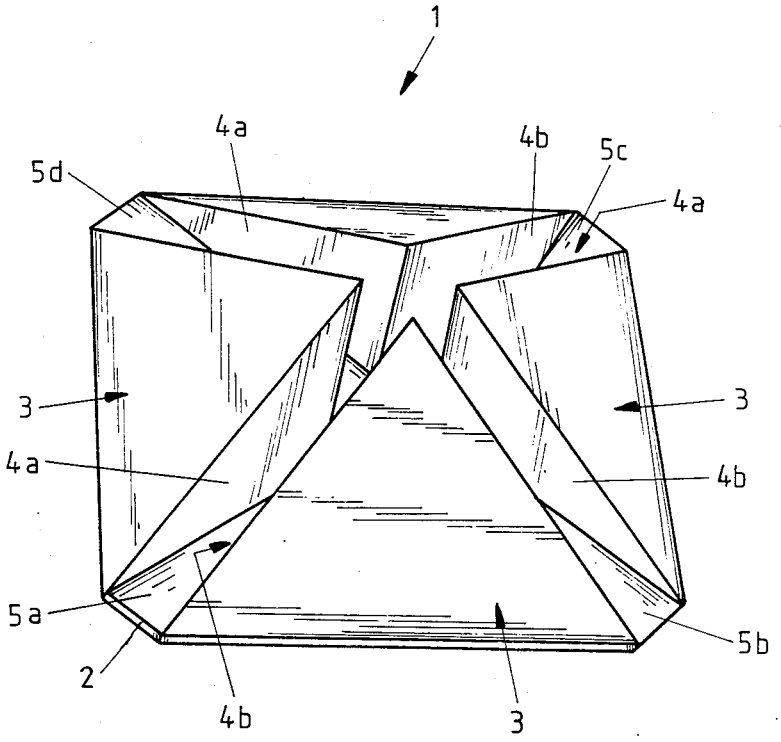
FIG. 1 shows a perspective view of a panel section interconnecting member according to the invention.

Referring first to FIG. 1, there is shown a perspective view of an embodiment of a panel section interconnecting member according to the present invention, generally designated with reference numeral 1. As can be seen from the drawing it comprises essentially a base plate member 2 of generally rectangular shape as well as a plurality of generally tetraedically shaped supporting members in the form of protrusions 3 rigidly mounted on said base plate 2. The preferred embodiment shown in FIG. 1 and further discussed hereinafter comprises four protrusions 3 arranged on one surface of the base plate 2 along the four edges thereof.

Each of the protrusions 3 includes a first side wall 4*a* as well as a second side wall 4*b*, both of said side walls 4*a* and 4*b* having a surface with the shape of a right-angled triangle. The planes of said surfaces 4*a* and 4*b* include essentially a right angle to each other. A further surface 4*c* of each of the protrusions 3 has the shape of a triangle as well, is arranged obliquely with regard to the plane of the base plate 2 and constitutes the upper surface of the panel section interconnecting member 1.

As can be clearly seen from FIG. 1 the four protrusions 3 are arranged on the base plate 1 with a certain distance to each other in such a way that four channels are formed between two adjacent protrusions 3. These channels are designated by reference numerals 5*a*, 5*b*, 5*c*, and 5*d*. The side walls of these channels 5 are constituted by the triangular surfaces 4*a* and 4*b* of the protrusions 3.

According to the embodiment shown in the drawings, all channels 5 have the same width, the channels 5*a* and 5*c* on the one hand and the channels 5*b* and 5*d* on the other hand being arranged along a straight line, respectively, these two straight lines being the diagonals of the base plate 2 and including a right angle with reference to each other. However, it is understood that e.g. the channels 5*a* and 5*b* might have a smaller width than the channels 5*b* and 5*d*, or vice versa, if panel members of different thickness have to be received.

The channels 5*a* to 5*d* defined by the side walls 4*a* and 4*b* of the protrusions 3 are adapted to receive vertical and horizontal panel members, as will be described hereinafter in more detail.

The panel section interconnecting member 1 shown in FIG. 1 may have a size of about 5 inches in square, the protrusions 3 protruding from the base plate 2 by about 1.5 to 2 inches. Of course the size depends on the shelf to be erected with the help of these panel section interconnecting members at will. Preferably the panel section interconnecting members are manufactured of a suitable plastic material and it is understood that the base plate 2 and the protrusions 3, respectively, have not to be constituted by separate units, but merely may be formed integrally. In the latter case the base plate 2 has not to be a real plate member as the protrusions 3 may be hollow and open at their back side, i.e. at the surface of the base plate 2 opposite to the surface on which the protrusions 3 are mounted.

Figure 2:
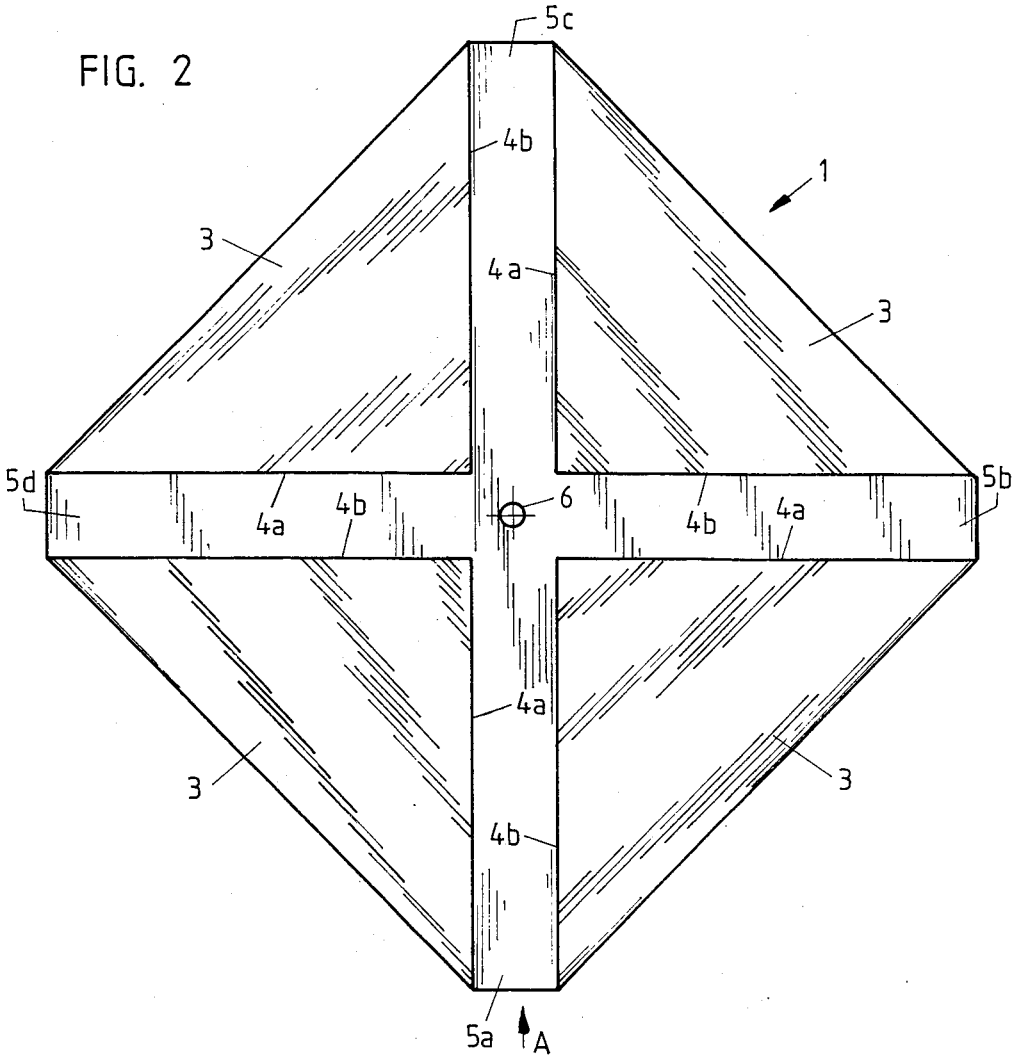
FIG. 2 shows a top view of the panel section interconnecting member according to FIG. 1.

Referring now to FIG. 2 of the drawings, there will be evident that the channels 5*a*, 5*b*, 5*c*, and 5*d* are in a cross-like configuration as seen from the top, the channels 5*a* and 5*c* defining a vertically arranged receiving channel for panel members of a shelf to be vertically mounted, and the channels 5*b* and 5*d* defining a horizontally arranged receiving channel for panel members of a shelf to be horizontally mounted, if the panel section interconnecting member 1 is mounted, e.g. to a vertical wall in the orientation as shown in FIG. 2. To this purpose the base plate 2 comprises an opening 6 in its center, i.e. at the point of intersection of the horizontally and the vertically arranged channels 5*b*, 5*d* and 5*a*, 5*c*, respectively. It is understood that the panel section interconnecting member 1 thereby may be mounted to a wall or the like by means of a screw (not shown) or similar means which penetrates said opening 6.

Figure 3:
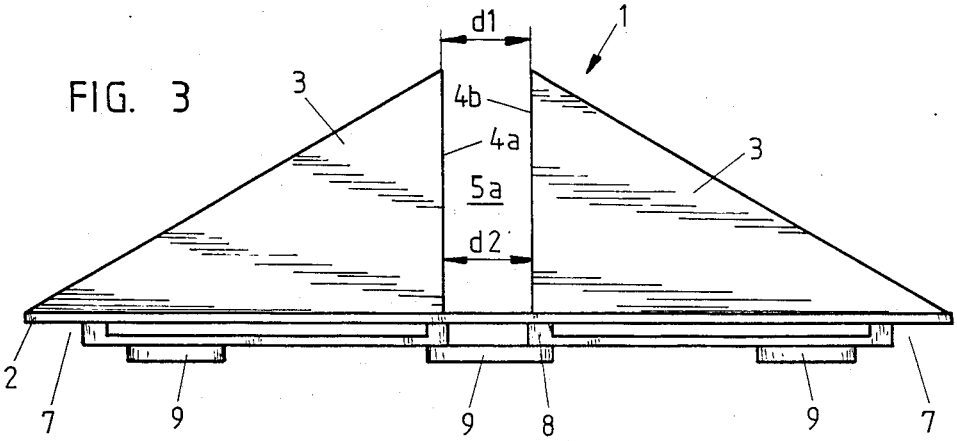
FIG. 3 shows a side view of the panel section interconnecting member according to FIG. 1, seen in the direction of arrow A in FIG. 2.

FIG. 3 shows a side view of the panel section interconnecting member 1 of FIGS. 1 and 2, seen in the direction of the arrow A in FIG. 2. It will be evident that the base plate member 2 comprises a circumferential recess 7, the puprose thereof being explained hereinafter in more detail. It may be further seen from FIG. 3 that the base plate member 2 is equipped with a plurality of base fixing members 8 and 9, respectively, protruding somewhat from the lower surface thereof. Particularly, there are provided a central fixing base member 8 arranged in the region of the cross point of the two channels 5 and four further base fixing members 9*a* to 9*c* arranged in the region of the four corners of the base plate member 2.

Figure 4:
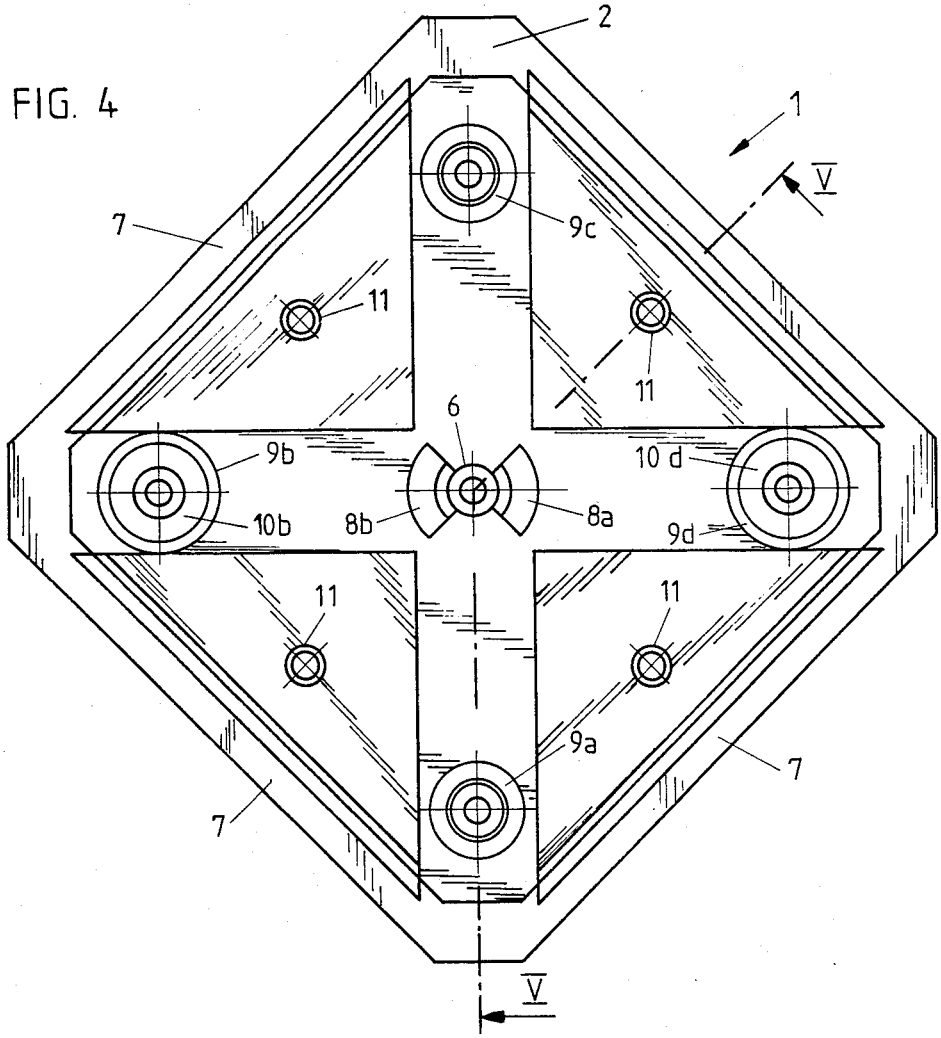
FIG. 4 shows a bottom view of the panel section interconnecting member according to FIG. 1.

FIG. 4 being a bottom view of the panel section interconnecting member 1 clearly shows the arrangement of the base fixing members 8 and 9. The central base fixing member 8 consists of two protruding sectors 8*a* and 8*b* in juxtaposition, each sector extending over an angle of 90 degrees and being arranged around the central opening 6 in the base plate member 2. The two base fixing members 9*a* and 9*c*, which are diagonally arranged with regard to each other in the region of two opposed corners of the base plate 2, have a smaller outer diameter than the two remaining base fixing members 9*b* and 9*d* arranged in the region of the two remaining diagonally opposed corners. The latter two base fixing members 9*b* and 9*d* comprise a circular recess 10*b* and 10*d*, the diameter thereof corresponding to the outer diameter of the two other base fixing members 9*a* and 9*c*. Of course the four base fixing members 9*a* to 9*d* are symmetrically arranged with regard to the central symmetry point, i.e. with regard to the central axis through the opening 6 of the base plate 2.

It is thereby possible to fix two panel section interconnecting members 1 together, the back side of the first panel section interconnecting member facing the back side of the second panel section interconnecting member. If the the second panel section interconnecting member is rotated by 90 degrees with regard to the first panel section interconnecting member, the protruding sectors 8*a* and 8*b* of the first panel section interconnecting member will engage the space between the protruding sectors 8*a* and 8*b* of the second panel section interconnecting member, thereby preventing any possibility of a pivoting displacement of the first panel section interconnecting member with regard to the second panel section interconnecting member around the central axis through their central opening 6.

Figure 10:
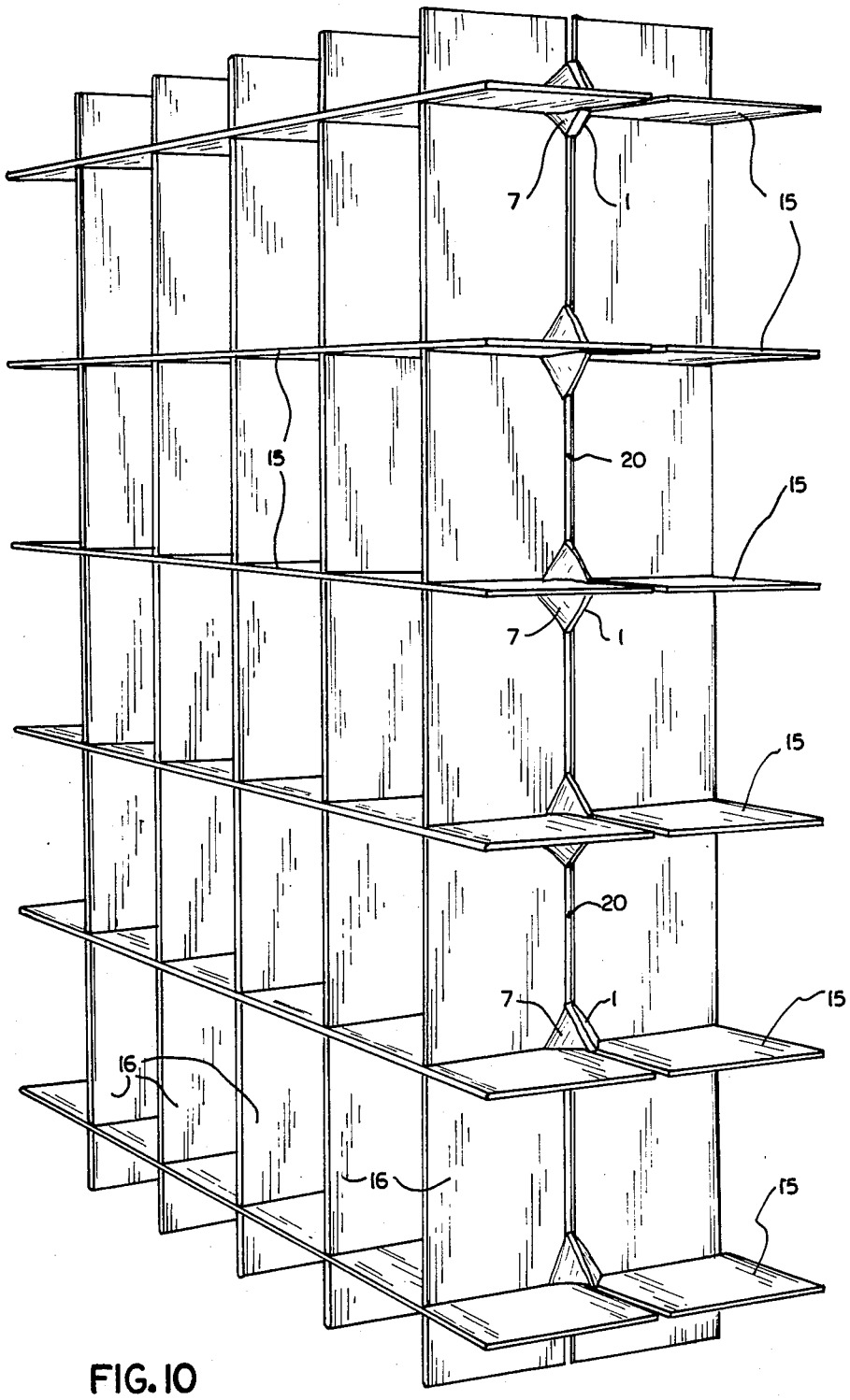
FIG. 10 shows a perspective view of a second embodiment of a free standing shelf in a double-sided version, incorporating the panel section interconnecting members according to the invention.

The first and the second panel section interconnecting members may be fixed together by means of a screw and a nut (not shown) penetrating the two central, coincidentally arranged openings 6. Moreover the base fixing members 9*a* and 9*c* of the first panel section interconnecting member will engage the circular recess provided in the base fixing members 9*b* and 9*d* of the second panel section interconnecting member, while, in turn, the base fixing members 9*a* and 9*c* of the second panel section interconnecting member will engage the base fixing members 9b and 9c of the first panel section interconnecting member. Thus a very rigid and reliable compound of two panel section interconnecting members may be realized, resulting in a strong and rigid structure of a double sided shelf as shown in FIG. 10 and which will be explained in greater detail hereinafter.

Figure 5:
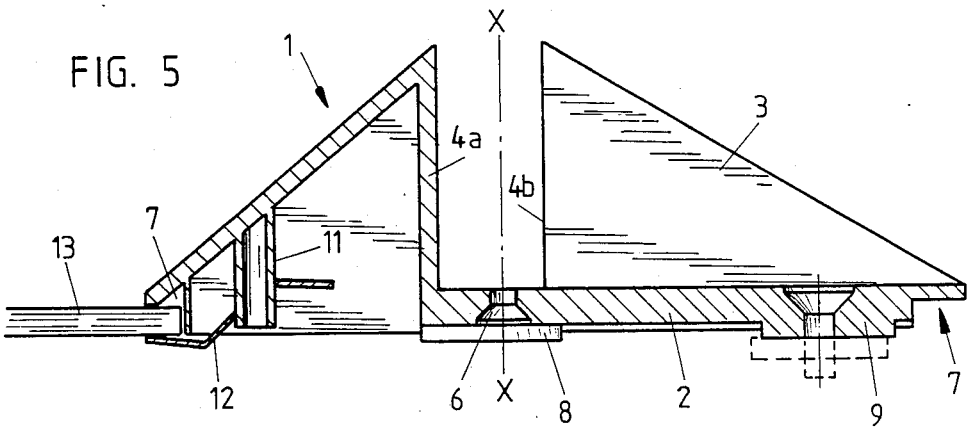
FIG. 5 shows a sectional view of the panel section interconnecting member according to FIG. 1, taken along the line V—V in FIG. 4.

FIG. 5 shows a sectional view of the panel section interconnecting member 1 along the line V—V in FIG. 4. As already mentioned earlier the protrusions 3 may be hollow, the back side thereof being open. Within the hollow space there is provided a tube-like flange 11 extending parallelly to the central axis X—X of the panel section interconnecting member and having its free end approximately in the plane of the back surface of the base plate member 2, each of said hollow space of the protrusions 3 comprising its own tube-like flange 11. Said tube-like flanges 11 may serve to receive clamping means 12 to fix background panels 13 which engage with their edge the circumferential recess 10 along the edges of the panel section interconnecting members 1. The provision of such background panels may be particularly useful if a doublesided shelf according to FIG. 10 is to be erected.

Although it may be not especially evident from the drawings, it must be emphasized that the pairs of surfaces, e.g. 4a or 4b, defining together the channels 5, run not exactly parallel with regard to each other, but merely merge somewhat towards their upper end. With other words, the distance d1 at the top is somewhat less than the distance d2 at the ground of each channel 5. The difference might be in the region of a few percent, preferably in the region of 1 to 3%. The reason is to provide a clamping effect excerted on a panel introduced into the channels 5, thereby avoiding an unintended slipping-out of any panel to be retained by the panel section interconnecting members 1. It is understood that the material of which the panel section interconnecting members are manufactured is somewhat elastically resilient such that the panels might be inserted into the channels 5 without difficulty. Of course the difference between the width d1 and the width d2 may vary according to the material to be used for manufacturing the panel section interconnecting members 1 and the resilient properties thereof, respectively.

Figure 6:
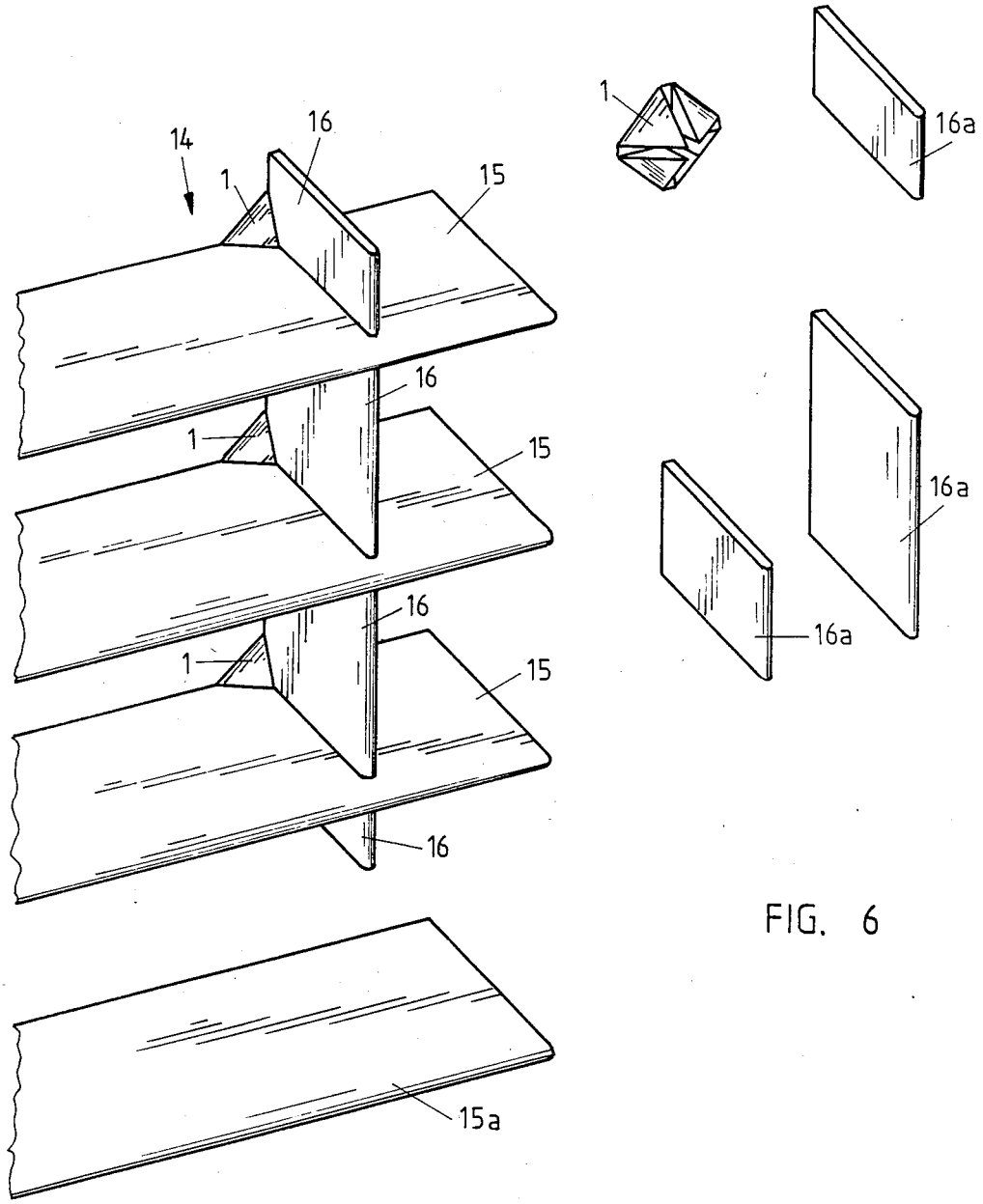
FIG. 6 shows a schematic perspective representation of a part of a shelf incorporating a plurality of different vertical and horizontal panel members as well as a plurality of panel section interconnecting members.

FIG. 6 shows a schematic perspective representation of a part of a shelf constructed in accordance with the present invention. The shelf, generally designated with reference numeral 14, incorporates a plurality of panel section interconnecting members 1, a plurality of horizontally extending panel members 15 of a relatively extended length and a plurality of vertically extending panel members 16 of comparatively short dimension. While the horizontal panel members 15 are of continuous configuration and are received in the channels 5a and 5c or in the channels 5b and 5d (see FIGS. 1 and 2), respectively, depending of the orientation of the panel section interconnecting member, the vertically extending short panel members 16 are subdivided, extend only up to the upper surface and from the lower surface of a horizontal panel member 15 to the upper surface of an adjacent horizontal panel member 15 etc.

In the right part of FIG. 5 there are shown a number of vertical panel members 16a of different height which could be used alternatively instead of the panel members 16 shown in the shelf in the left part of the drawing, depending upon the desired distance between the horizontal panel members 15. Correspondingly an alternative horizontal panel member 15a of greater depth is shown at the bottom of FIG. 6; this panel member 15a might be used instead of one of the panel members 15 shown in FIG. 6.

Figure 9:
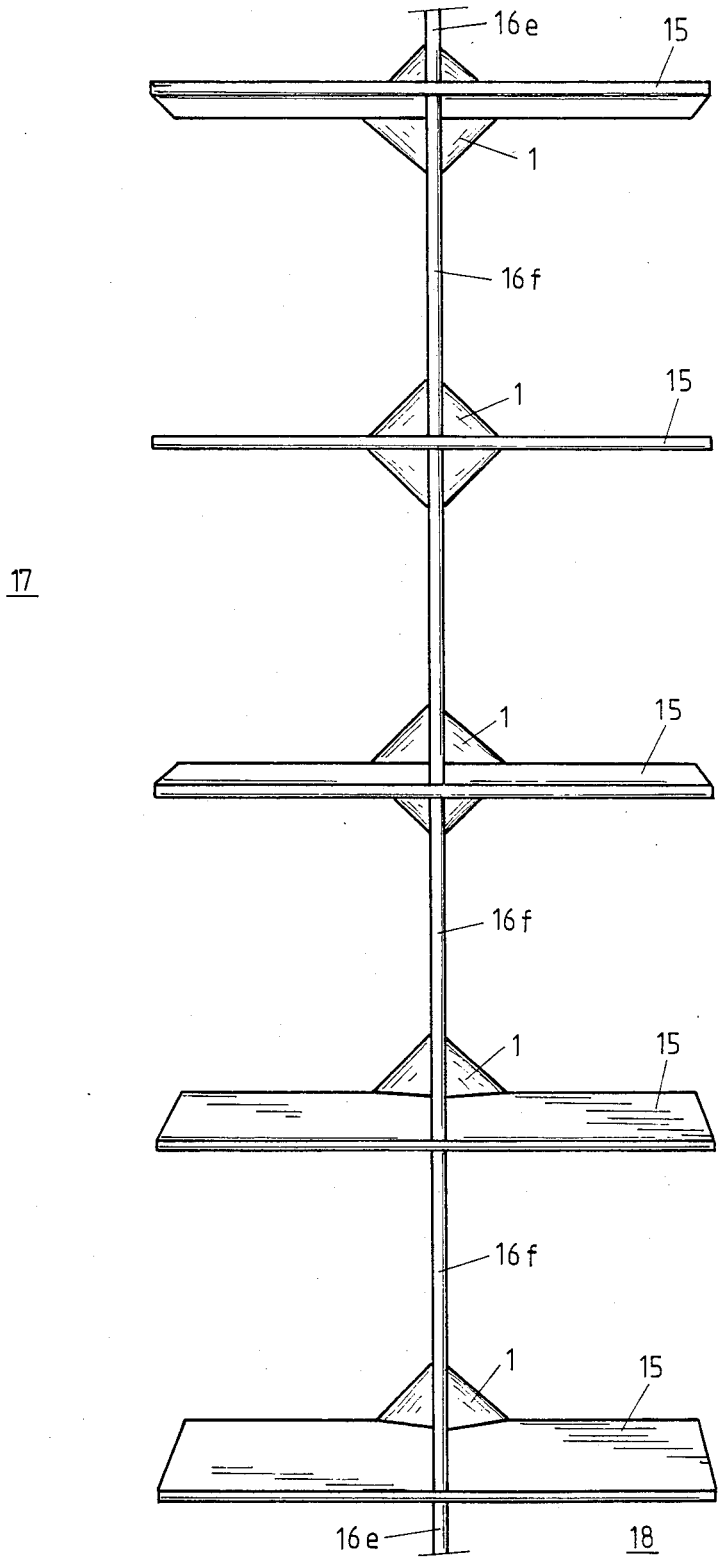
FIG. 9 shows a perspective view of a first embodiment of a shelf mounted to a wall and incorporating the panel section interconnecting member according to the invention.

Anyway it might be desirable that the shelf shown in FIG. 6 or any similar shelf constructed in accordance with the present invention is supported by the floor. That means that the lowermost vertical panel member 16 rests with its lower edge against the floor and thereby supports the whole shelf structure. Furthermore, particularly in the case of comparatively narrow and simultaneously high shelf structures, e.g. as shown in FIG. 9, it might be desirable to fix at least some of the panel section interconnecting members to the wall. This may be easily be accomplished by means of screws or the like fixing member, penetrating the central opening 6 of said panel section interconnecting members to be fixed, which may be anchored by known means in the wall.

Figure 7:
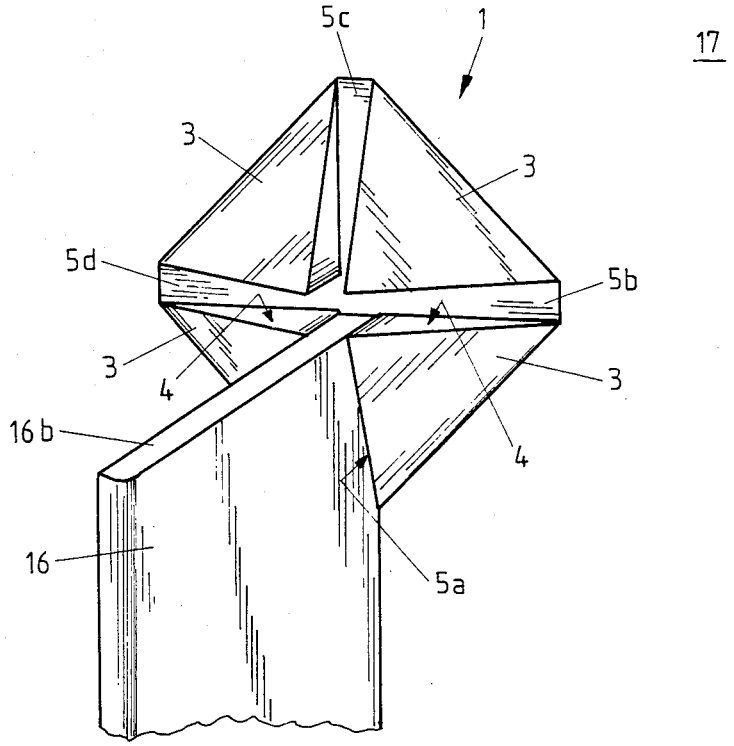
FIG. 7 shows a detailed perspective partial view of a shelf to be erected, in a first phase of construction, i.e. a panel section interconnecting member and a single vertical panel member inserted therein.

FIG. 7 shows detailled perspective partial view of a shelf to be erected in a first phase of construction. It may be clearly seen that a panel section interconnecting member 1 has been fixed to a wall 17 by means of a screw (not shown). The lowermost vertical panel member 16 has been inserted into the lower, vertically oriented channel 5a and is clampingly retained therein due to the clamping action of the inclined side-walls of that channel 5a, as hereinbefore explained. The lower (not shown) edge of the panel member 16 rests against the floor, while the upper edge 16b of the panel member 16 is aligned with the lower side walls 4 of the horizontally extending channels 5b and 5d.

While FIG. 7 shows only a partial view of the shelf construction to be erected, it should be quite obvious that a plurality of lowermost panel section interconnecting members 1 as well as a plurality of lowermost panel members 16 may be provided, in a predetermined distance to each other, but all at the same height on the wall, depending of the size and width of the shelf to be erected. Anyway, the first phase according to FIG. 7 and as hereinbefore explained having completed, the panel section interconnecting member 1 (or the plurality of panel section interconnecting member 1) mounted to the wall and equipped with the lowermost vertical panel members now are ready to receive the lowermost horizontal panel member, as will be explained in connection with FIG. 8.

Figure 8:
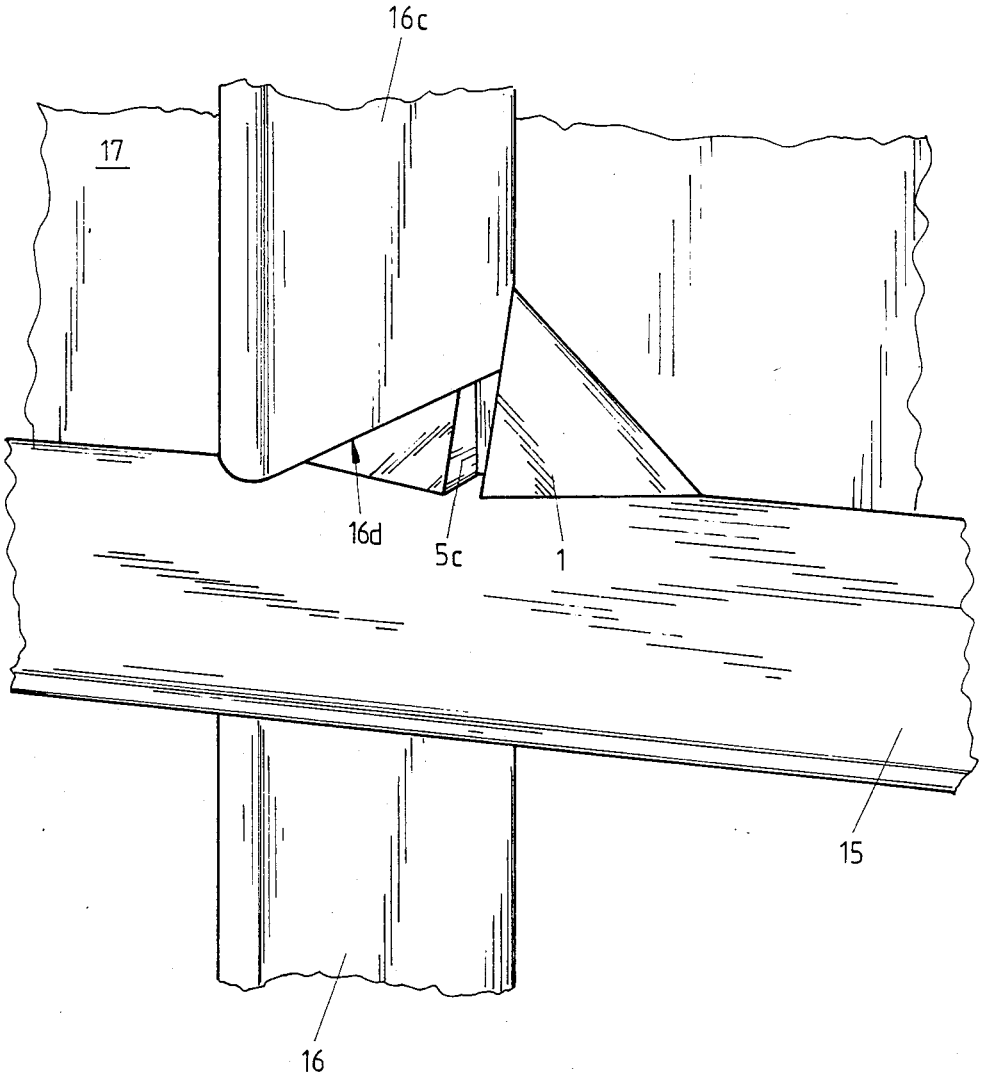
FIG. 8 shows a detailed perspective partial view of a shelf to be erected, but in a second phase of construction.

Turning now to FIG. 8, the panel section interconnecting member 1 mounted to the wall 17 as well as the lowermost vertical panel member 16 may be recognized. Furthermore a horizontally extending panel member 15 has been inserted into the channels 5b and 5d (cf. FIG. 7) and is clampingly retained therein. The lower surface of the horizontal panel member 15 rests on and is supported by the upper edge 16b (FIG. 7) of the lowermost vertical panel member 16. Again the same situation as shown in FIG. 8 will be present at further lowermost panel section interconnecting members which might have been mounted to the wall and equipped with a lowermost vertical panel member (not shown) for the construction of a shelf structure with extended width.

As a next step, a further vertical panel member 16c is inserted into the channel 5c of the panel section interconnecting member 1 in such a way that its lower edge 16d rests on and is supported by the upper surface of the horizontal panel member 15. It is understood that side walls 4 terminating the channel 5*c* are somewhat obliquely arranged as well, as hereinbefore described, and thereby firmly retain the inserted vertical panel member 16*c* by the clamping action excerted thereon.

Now the steps explained in connection with FIGS. 7 and 8 are repeated, but at a greater height on the wall, i.e. further panel section interconnecting members 1 are mounted to the wall 17 in the region of the upper edge of the vertical panel members 16*c*, and further horizontally extending panel members (not shown) are inserted into the corresponding horizontally extending channels of said further panel section interconnecting members, until the desired height of the shelf structure is reached.

Turning now to FIG. 9 there is shown a perspective view of a first embodiment of a shelf mounted to a wall 17. It comprises a plurality of panel section interconnecting members 1 equidistantially mounted to the wall 17 along a straight, vertical line. Furthermore there is provided a first vertically arranged, lowermost panel member 16*e* resting on the floor 18 and supporting the whole shelf structure. A first, lowermost horizontal panel member 15 is clampingly retained by the first, lowermost panel section interconnecting member 1 and rests with its lower surface on the upper edge of said lowermost vertical panel member 16*e*. The upper surface of said lowermost horizontal panel member 15 supports a second, vertically arranged panel member 16*f* which also is clampingly retained in the upper, vertically extending channel 5*c* of said lowermost panel section interconnecting member 1 in the region of its lower edge, but retained by the lowermost vertically extending channel 5*a* of the next, upper panel section interconnecting member 1. Thereby a plurality of succesive panel section interconnecting members 1, a plurality of vertically extending panel members 16*f* and a plurality of horizontally extending panel members 15 may be arranged to form a shelf structure with the desired height, the uppermost vertical panel members 16*e* preferably being of shorter dimension similar to the lowermost ones.

In a similar way there may be erected a shelf structure of greater width by arranging a further plurality of panel section interconnecting members 1, again along a straigt vertical line parallel to the panel section interconnecting members 1 shown in FIG. 9, but in certain distance thereof. Of course one would have to use horizontal panel members 15 of greater width and being supported and received by all the panel section interconnecting members 1 mounted to the wall at the same height.

FIG. 10 shows an embodiment of a free standing, double sided shelf structure incorporating a plurality of panel section interconnecting members 1, a plurality of horizontally extending panel members 15 and a plurality of vertically extending panel members 16. To erect such a double sided shelf structure, there is used a plurality of double panel section interconnecting members 1, two thereof being connected back side to back side as explained hereinbefore. Furthermore a background panel 13 may be used, consisting of a plurality of individual background panel members engaging with their edges the recesses 10 arranged along the edges of the panel section interconnecting members 1 and being fixed thereto by means of clamping means 12, as shown in FIG. 5.

What I claim is:

1. A panel section connector adapted to be used in the construction of shelf structures of shelf-like furniture, comprising:

a generally rectangular base member having a first surface, a second surface opposite to said first surface and four side edges;

first, second, third and fourth generally tetrahedrally shaped supporting members extending from said first surface of said base member and each including a first triangular side wall arranged approximately perpendicular to said first surface of said base member, a second triangular side wall aranged approximately perpendicular to said first surface of said base member and to said first side wall, and a third triangular top surface oblique to said first surface;

said first side wall of said first supporting member being approximately parallel to and spaced apart from said second side wall of said second supporting member to define therebetween a first receiving channel, said first side wall of said second supporting member being approximately parallel to and spaced apart said second side wall of said third supporting member to define therebetween a second receiving channel, said first side wall of said third supporting member being approximately parallel to and spaced apart from said second side wall of said fourth supporting member to define therebetween a third receiving channel, and said first side wall of said fourth supporting member being approximately parallel to and spaced apart from said second side wall of said first supporting member to define therebetween a fourth receiving channel, each of said receiving channels being adapted to receive a panel member of the shelf structure to be erected;

said first, second, third and fourth receiving channels together forming an approximately cross-shaped channel configuration having a pair of continuous open receiving channels extending completely across said first surface of said base member and parallel to a diagonal of said base member; and said base member having a central opening therethrough adapted to receive mounting means for mounting said panel section connector to another structure.

2. A panel section connector as defined in claim 1, further comprising mating means located on said second surface of said base member, said mating means comprising at least one projecting member and at least one receiving means so constructed and arranged relative to each other that said first panel section connector may be joined in mating relation to a substantially identical inverted second panel section connector with said projecting member of said first connector being received in said receiving means of said inverted second connector and said projecting member of said second connector being received in said receiving means of said first connector, the central openings of said base members of said first and second connectors being substantially aligned with each other when said connectors are in mating relation with each other.

3. A panel section connector as defined in claim 2, wherein said mating means comprises a pair of said projecting members and a pair of said receiving means, said projecting members being located diagonally opposite each other and equally spaced about the central opening in said base member, each of said projecting members having an angular extent of approximately 90° about the central opening, said pair of said projecting members defining a pair of diagonally opposed spaces located angularly between said projecting members, and said pair of spaces constituting said pair of receiving means, whereby said first and second connectors may be joined in mating relation in a predetermined position of orientation and at least one other position of orientation 180° out-of-phase therefrom and are impeded from rotating relative to each other when in mating relation.

4. A panel section connector according to claim 3, further comprising first, second, third and fourth non-centrally located mating members, said first and third mating members being spaced diagonally opposed to each other adjacent opposite corners of said rectangular base member, said second and fourth mating members being spaced diagonally opposed to each other adjacent the other two opposite corners of said rectangular base member, said first and third mating members each comprising a cylindrical member with a predetermined outer diameter, said second and fourth mating members each comprising a cylindrical recess having a diameter corresponding to said predetermined outer diameter of said first and third mating members and adapted to matingly receive therein one of said cylindrical members.

5. A panel section connector as defined in one of claims 1 or 2 wherein said supporting members are integrally formed with said base member.

6. A panel section connector as defined on one of claims 1, 2 or 4 wherein said supporting members are hollow, and further comprising means defining a circumferential recess along the edges of said panel section connector adapted to receive the edges of at least one background panel member and at least one tube means extending from one of said top surfaces within a hollow space of the supporting member parallel to the central axis of said panel section connector, and clamping means engaged with said tube means for clampingly retaining said at least one background member.

7. A panel section connector as defined in one of claims 1, 2 or 4 wherein said first, second, third and fourth channels are of an identical width.

8. A panel section connector as defined in one of claims 1, 2 or 4 wherein said first and third channels have a first width and said second and said fourth channels have a second width which is different from said first width.

9. A panel section connector as defined in one of claims 1, 2 or 4 wherein the width of each of said first, second, third and fourth channels is less at a first location from said base member than at a second location closer to said base member.

10. A shelf structure including a plurality of horizontally extending panel members, a plurality of vertically extending panel members and a plurality of panel section connectors adapted to rigidly interconnect said vertically extending panel members and said horizontally extending panel members, each panel section connector comprising:

a generally rectangular base member having a first surface, a second surface opposite to said first surface and four side edges;

first, second, third and fourth generally tetrahedrally shaped supporting members extending from said first surface of said base member and each including a first triangular side wall arranged approximately perpendicular to said first surface of said base member, a second triangular side wall arranged approximately perpendicular to said first surface of said base member and to said first side wall, and a third triangular top surface oblique to said first surface;

said first side wall of said first supporting member being approximately parallel to and spaced apart from said second side wall of said second supporting member to define therebetween a first receiving channel, said first side wall of said second supporting member being approximately parallel to and spaced apart said second side wall of said third supporting member to define therebetween a second receiving channel, said first side wall of said third supporting member being approximately parallel to and spaced apart from said second side wall of said fourth supporting member to define therebetween a third receiving channel, and said first side wall of said fourth supporting member being approximately parallel to and spaced apart from said second side wall of said first supporting member to define therebetween a fourth receiving channel, each of said receiving channels being adapted to receive a panel member of thr shelf structure;

said first, second, third and fourth receiving channels together forming an approximately cross-shaped channel configuration having a pair of continuous open receiving channels extending completely across said first surface of said base member and parallel to a diagonal of said base member; and said first channel of each of said panel section connectors receiving and supporting a first vertically extending panel member, said third channel of each of said panel section connectors receiving and supporting a second vertically extending panel member, and said second and said fourth channels of each of said panel section connectors together receiving and supporting a horizontally extending panel member.

11. A shelf structure as defined in claim 10, wherein said panel section connector comprises mating means located on said second surface of said base member, said mating means comprising at least one projecting member and at least one receiving means so constructed and arranged relative to each other that said first panel section connector may be joined in mating relation to a substantially identical inverted second panel section connector with said projecting member of said first connector being received in said receiving means of said inverted second connector and said projecting member of said second connector being received in said receiving means of said first connector, the central openings of said base members of said first and second connectors being substantially aligned with each other when said connectors are in mating relation with each other.

12. A shelf structure as defined in claim 11, wherein said panel section connector mating means comprises a pair of said projecting members and a pair of said receiving means, said projecting members being located diagonally opposite each other and equally spaced about the central opening in said base member, each of said projecting members having an angular extent of approximately 90° about the central opening, said pair of said projecting members defining a pair of diagonally opposed spaces located angularly between said projecting members, and said pair of spaces constituting said pair of receiving means, whereby said first and second connectors may be joined in mating relation in a predetermined position of orientation and at least one other position of orientation 180° out-of-phase therefrom and are impeded from rotating relative to each other when in mating relation.

13. A shelf structure as defined in claim 12, wherein said panel section connector further comprises first, second, third and fourth noncentrally located mating members, said first and third mating members being spaced diagonally opposed to each other adjacent opposite corners of said rectangular base member, said second and fourth mating members being spaced diagonally opposed to each other adjacent the other two opposite corners of said rectangular base member, said first and third mating members each comprising a cylindrical member with a predetermined outer diameter, said second and fourth mating members each comprising a cylindrical recess having a diameter corresponding to said predetermined outer diameter of said first and third mating members and adapted to matingly receive therein one of said cylindrical members.

14. A shelf structure including a plurality of horizontally extending panel members, a plurality of vertically extending panel members and a plurality of pairs of panel section connectors adapted to rigidly interconnect said vertically extending panel members and said horizontally extending panel members, each of said pairs of panel section connectors comprising a first panel section connector joined in mating relation to a second inverted panel section connector substantially identical to said first connector, each of said first and said second panel connectors comprising:

a generally rectangular base member having a first surface, a second surface opposite to said first surface and four side edges;

first, second, third and fourth generally tetrahedrally shaped supporting members extending from said first surface of said base member and each including a first triangular side wall arranged approximately perpendicular to said first surface of said base member and each including a first triangular side wall arranged approximately perpendicular to said first surface of said base member, a second triangular side wall arranged approximately perpendicular to said first surface of said base member and to said first side wall, and a third triangular top surface oblique to said first surface;

said first side wall of said first supporting member being approximately parallel to and spaced apart from said second side wall of said second supporting member to define therebetween a first receiving channel, said first side wall of said second supporting member being approximately parallel to and spaced apart said second side wall of said third supporting member to define therebetween a second receiving channel, said first side wall of said third supporting member being approximately parallel to and spaced apart from said second side wall of said fourth supporting member to define therebetween a third receiving channel, and said first side wall of said fourth supporting member being approximately parallel to and spaced apart from said second side wall of said first supporting member to define therebetween a fourth receiving channel, each of said receiving channels being adapted to receive a panel member of the shelf structure;

said first, second, third and fourth receiving channels together forming an approximately cross-shaped channel configuration having a pair of continuous open receiving channels extending completely across said first surface of said base member and parallel to a diagonal of said base member; and said first channels of each of said first and second panel section connectors receiving and supporting first vertically extending panel members, said third channels of each of said first and second panel section connectors receiving and supporting second vertically extending panel members, and said second and fourth channels of each of said first and second panel section connectors together receiving and supporting horizontally extending panel members.

* * * * *